US008771394B2

(12) United States Patent
Skofteland et al.

(10) Patent No.: US 8,771,394 B2
(45) Date of Patent: Jul. 8, 2014

(54) DEVICE FOR SEPARATING AND COLLECTING FLUID IN GAS FROM A RESERVOIR

(75) Inventors: Håkon Skofteland, Jar (NO); Kjell Olav Stinessen, Oslo (NO)

(73) Assignee: Aker Subsea, Lysaker (NO)

( * ) Notice: Subject to any disclaimer, the term of this patent is extended or adjusted under 35 U.S.C. 154(b) by 565 days.

(21) Appl. No.: 13/059,047

(22) PCT Filed: Jul. 13, 2009

(86) PCT No.: PCT/NO2009/000288

§ 371 (c)(1),
(2), (4) Date: May 9, 2011

(87) PCT Pub. No.: WO2010/019052

PCT Pub. Date: Feb. 18, 2010

(65) Prior Publication Data

US 2011/0203460 A1 Aug. 25, 2011

(30) Foreign Application Priority Data

Aug. 15, 2008 (NO) ..... 20083556

(51) Int. Cl.
*B01D 45/00* (2006.01)
*B01D 45/18* (2006.01)

(52) U.S. Cl.
USPC ..... 55/431; 55/385.1; 55/447; 55/466; 96/188; 96/193; 96/408; 96/412

(58) Field of Classification Search
USPC ..... 55/385.1, 428, 430, 431, 466, 447; 96/397, 408, 412, 188, 193
See application file for complete search history.

(56) References Cited

U.S. PATENT DOCUMENTS 7,819,950 B2 * 10/2010 Stinessen et al. ..... 95/153
7,909,910 B2 * 3/2011 Benner ..... 95/25

FOREIGN PATENT DOCUMENTS

| | | |
|---|---|---|
| WO | WO-99/35370 | 7/1999 |
| WO | WO-2005/026497 A1 | 3/2005 |
| WO | WO-2008/004882 A1 | 1/2008 |
| WO | WO-2008/004883 A1 | 1/2008 |

OTHER PUBLICATIONS

International Search Report from the Swedish Patent Office for International Application No. PCT/NO2009/000288 (Mail date Nov. 6, 2009).

* cited by examiner

*Primary Examiner* — Robert Clemente
(74) *Attorney, Agent, or Firm* — Finnegan, Henderson, Farabow, Garrett & Dunner LLP

(57) ABSTRACT

A device for separating and collecting liquid in gas from a reservoir, which is attached to processing equipment (14, 15) for gas, said gas being delivered to the processing equipment from the device via an inlet pipe (24) to the processing equipment and the collected liquid is removed periodically from the device via liquid outlet pipe (7). The device is formed of a liquid separator (1) and a liquid collector (2) which are two separate chambers, and which are connected to each other via a valve (3), and that for draining of the collected liquid, the liquid collector (2) is connected to an outlet pipe (19) from the processing equipment via an intermediate valve (6), draining taking place with the aid of compressed gas which via the intermediate valve (6) is supplied from the processing equipment, or alternatively from onshore or a platform, from a gas pipe or a well stream gas pipe on the seabed or the like.

30 Claims, 15 Drawing Sheets

DEVICE FOR SEPARATING AND COLLECTING FLUID IN GAS FROM A RESERVOIR

The present invention utilises the energy in compressed gas for draining and sand flushing, with swirling of sand and other particles, of a subsea liquid separator with associated liquid collector.

BACKGROUND OF THE INVENTION

To protect processing equipment, and in particular gas processing equipment, against unacceptable inflow of liquid, which also may contain sand and other particles, hereafter referred to by the collective term "sand", a liquid separator is as a rule placed upstream of the equipment. Liquid and sand are thus collected such that gas and liquid, with sand, can then be treated separately.

Such protection of subsea compressors against too great an inflow of liquid and sand is previously known, and is generally effected by placing a liquid separator upstream of the compressor, such that liquid and sand can be separated from the well stream, collected and pumped into the gas transport pipe at a point downstream of the compressor, or optionally that the liquid is conveyed in a separate pipe.

Liquid separators may in this context mean, inter alia, separators, scrubbers, cyclones and liquid slug catchers, all of which, in addition to the actual separator, have a volume for collected liquid. This collecting volume will be determined by several factors such as:

- Average liquid content of the well stream gas. This may vary enormously depending on whether the well stream gas comes from a dry gas field or a gas condensate field. There may be a field-dependent variation from 0.01% by weight or lower to 5% by weight or more, without this having any significance for the invention other than the practical dimensioning and operation. In multiphase pumping from the oil field, the liquid fraction may typically be 2% by volume to 30% by volume.
- Liquid slug volume, i.e., the volume of a liquid accumulation which for various reasons has occurred in the pipe system upstream of the compressor, and which flows into the liquid separator in the course of a few seconds.

To illustrate some of the disadvantages of the previously known solutions there follows a description of a common way of draining liquid from a subsea liquid separator with an associated volume for liquid collection. Reference is therefore made to FIG. 1 which illustrates the main equipment in such conventional subsea compression and pumping stations. Table 1 names the components to which the letters in the figure refer.

TABLE 1

| | |
|---|---|
| A | Liquid separator with collecting volume in common vessel |
| B | Compressor |
| b' | Compressor motor |
| C | Pump |
| c' | Pump motor |
| D | Lower permitted control level for liquid |
| E | Upper permitted control level for liquid when flow is stable |
| F | Highest liquid level, determined by liquid slug volume |
| G | Secondary cleaning equipment, e.g., cyclones |
| g' | Lower edge of secondary cleaning equipment |
| H | Downpipe for liquid from secondary cleaning equipment |
| I | Outlet from downpipe |
| J | Anti-surge valve with actuator |
| K | Anti-surge cooler |
| L | Cable for supply of electric power to compressor motor |

TABLE 1-continued

| | |
|---|---|
| M | Cable for supply of electric power to pump motor |
| N | Liquid recirculation pipe |
| O | Gas recirculation pipe |
| p, p', p'', p''' | Shut-off valves |
| Q | Electrical connector for compressor motor |
| q' | Electrical connector for pump motor |
| R | Liquid circulation valve |

During normal operation all the illustrated shut-off valves, p, p'', p''', are open and the anti-surge valve, j, is closed. At a given time, the compressor, b, runs at a certain speed in order to give desired gas production. The compressor is run by the electric motor, b', which is supplied with electric power through the cable, l, that is connected to the compressor motor by an electrical connector, q. Similarly, the pump receives electric power through the cable, m, and the connector, q'.

The gas that flows out of the reservoir well, i.e., wet gas, to the liquid separator with its collecting volume, a, contains a certain average liquid content which under certain conditions may be disturbed by a transient liquid slug of high liquid content and short duration. It is important to be aware that during operation it is rare that several such liquid slugs come in rapid succession because the gas over a specific period has a given average liquid content.

In FIG. 1 a specific permitted liquid level, from d to f, is indicated in the liquid collector. When the pump is a centrifugal pump that is capable of forming bubbles, the lower level, d, is determined by the pump requiring a minimum head for the lower liquid level, d, in relation to the suction of the pump, c. The required head, "Net Positive Suction Head Required" (NPSHR) varies depending on the structure and operating conditions of the centrifugal pump, especially its speed, but may, for example to be of 3 to 4 meters. The lower liquid level, d, must also be so high that the centrifugal pump is protected against entrainment of free gas in its liquid stream. Centrifugal pumps are sensitive to free gas because the pumping capability, i.e., the capability to create pressure increase and capacity, diminishes together with the degree of efficiency, and the need for operating power increases. A common rule is that free gas in centrifugal pumps should be kept lower than 3% by volume. When the requirement for NPSHR is met, this rule is also observed automatically.

Furthermore, the highest permitted normal liquid level, e, when flow is stable is determined by the protection against unduly high amounts of liquid being entrained by the gas and passed into the compressor when the largest liquid slug, i.e., the dimensioning slug, comes on top of the upper permitted normal level, e, when flow is stable. The highest liquid level, f, is given in that the "largest liquid slug"—determined by calculations, measurements or empirically—is to have room on top of the upper normal liquid level, e, without the absolute upper permitted highest liquid level, f, being exceeded. It should be mentioned that the absolute highest liquid level, f, as regards location of the secondary cleaning equipment, g, when cyclones or other secondary cleaning equipment requiring downpipe, h, for draining is used, is determined by the drop in pressure across the secondary cleaning equipment, which is installed in the upper part of the liquid separator, a. The length of the downpipe, h, from the lower edge, g', of the secondary cleaning equipment down to the highest permitted liquid level, f, must give sufficient static height to drain the secondary cleaning equipment which often consists of cyclones that have a drop in pressure in the range of 0.1 to 0.5 bar. Furthermore, the outlet, i, from the downpipe, h, must always be submerged in liquid to prevent gas from being sucked up through the downpipe, h. This means that the outlet, i, must be located below the lower permitted liquid level, d.

If simpler equipment, e.g., wire mesh mats, provide satisfactory secondary cleaning and thus droplet removal, the height between the secondary cleaning equipment, g, and the highest liquid level, f, can be reduced because the downpipe then becomes unnecessary. The mechanism for ensuring that liquid droplets that are caught in wire mesh mats and the like, is that the droplets fuse together to obtain a size that causes them to fall down through the gas rising towards the wire mesh mats, i.e., that the fall rate for the droplets is greater than the gas rate upwards.

What constitutes an "unduly high" liquid and sand load for the compressor depends on how robust its structure is in relation to this load, and the choice of materials and any protective coating against erosion on the compressor impellers. Centrifugal compressors can withstand an infrequent and transient high liquid load, e.g., 2% by volume, provided that the droplet diameter is not too large, i.e., typically less than 50 μm. Compressor suppliers also state that compressors can be run continuously with liquid, provided that the liquid content is less than 2% by volume. Other suppliers of centrifugal compressors state that compressors can be run with up to 2% by volume of liquid continuously in the inlet, droplets smaller than 50 μm, with acceptable erosion and lifetime.

During operation, the pump for the conventional solution is so controlled that the level in the liquid separator is kept between the upper liquid level, e, and the lower level, d. It is then usually controlled towards an "ideal level", somewhere between d and e. This is a level that is determined to protect the pump against both bubble formation and entrainment of free gas, and which at the same time is sufficiently low to prevent liquid entrainment to the compressor.

The liquid that is separated out in the liquid separator, a, is collected in its collecting volume. In known solutions, the pump, c, is indicated as a centrifugal pump. These pumps are well suited for pumping when the liquid production in cubic meters per hour, $m^3/h$, is not too small, so that the pumps can then be designed for the rise in pressure that may be required. Typically, the need for a rise in pressure can vary from 5 bar to 100 bar and even more.

As an example to illustrate the problems associated with known solutions, there may be chosen a typical case of a smallish gas field which only requires one compressor, and where the liquid production is 10 $m^3$/day, i.e., 0.4 $m^3/h$. In the example in question, this corresponds to a liquid content in the gas of about 0.01% by volume and a required rise in pressure of 30 bar from suction pressure which is 10 bar. There are no centrifugal pumps which, with continuous operation, can satisfy such a small requirement for volume flow with the necessary increase in pressure. One solution for continuous operation of the pump may involve recycling almost the whole volume of liquid so as to obtain satisfactory minimum liquid flow into the pump, e.g., 70 $m^3/h$.

When comparing the liquid load that centrifugal processors can withstand in relation to the liquid content in fields of gas or a mixture of gas and condensate, as mentioned above, centrifugal compressors can in theory be run without liquid separation from the gas. However, this is a theoretical consideration which requires that the liquid should flow evenly dispersed in the gas. This state may be considered as normal for most of the operating time for a subsea compressor, but can sometimes be disturbed by larger liquid concentrations, in the worst case in the form of liquid slugs which fill the whole pipe cross-section. The mechanisms that result in the occurrence of such liquid slugs are typically changes, i.e., transients, which lead to liquid accumulation, e.g., at the start-up or shutdown of one or more wells on a template. The worst case is probably the start-up of the wells on the template where all the wells have been shut down. A great deal of liquid may then collect and flow towards the compressor. To avoid the liquid separator, a, having to be dimensioned to withstand the transient liquid slug at the start-Up, special start-up procedures may be devised. For example, the liquid slug can either be run past the compressor in a separate by-pass pipe or run in portions through the liquid separator, a.

Regardless of whether the compressor tolerates liquid, it is good protection against unnecessary wear or breakdown to conduct the liquid, which also has a certain sand content, around the compressor, especially when, as made possible by the present invention, a separate pump with power supply is not required.

For the compressor, it is thus its robustness against liquid and sand that determines the design of the gas processing part of the liquid separator, and similarly it is the robustness of the pump as regards bubble formation and entrained gas that determines the structure of the liquid processing part. As regards the setting of the accuracy and complexity of the level control, the same robustness of the two parts is also of particular importance.

FIG. 2 illustrates how use of a centrifugal pump pushes up the total constructional height of pump and liquid separator and its collecting volume in order to meet NPSHR.

It can be seen from the example that a height difference between the lowest liquid level and the intake to the pump is 4 meters.

To determine the total constructional height of the arrangement of compressor, liquid separator/collector and pump, it must be taken into account that the compressor and/or the compressor motor may require draining. In known solutions, gravity is used for draining. To ensure draining by gravity, the lower part of the compressor must be located approximately 0.5 meters above a lower level in the liquid collector.

The consequence of using a centrifugal pump and draining by gravity is a large constructional height for the whole arrangement as mentioned in the paragraph above. In FIG. 2 as an example it is indicated as 10.5 meters. A typical diameter of some components is also indicated.

In the example, a vertically oriented compressor and compressor motor are shown. If the two components are horizontal, the constructional height is reduced, but on the other hand the width increases.

FIG. 2 includes only components that are necessary to illustrate the need for height. The symbols here are the same as for FIG. 1, but in addition there is

TABLE 2

| | |
|---|---|
| z | Drainage pipe for compressor with compressor motor |

SUMMARY OF THE INVENTION

The main object of the present invention is therefore to show an improved solution for separating and collecting liquid, typically water, condensate and oil with added chemicals, the mixture being highly reservoir-dependent, entrained in gas which comes from a reservoir. By improvement is meant primarily that the need for a pump is eliminated and with it the pump's need for head since draining of the liquid collector is carried out using compressed gas. Furthermore, the term improvement implies that draining for the compressor with motor is carried out using compressed gas and therefore the need for head in relation to the liquid level in the liquid collecting unit disappears, i.e., that the compressor and its associated compressor motor, if such is included in the processing equipment, can be located freely with regard to height in relation to the liquid collector. As shown below, this gives a substantial height reduction for the whole arrangement.

This main object is achieved by means of a device for separating and collecting liquid entrained in gas from a reservoir, which is attached to processing equipment for the gas, said gas being delivered to the processing equipment from the device via an inlet pipe to the processing equipment and the collected liquid being removed periodically from the device in a liquid outlet pipe, characterised in that the device is formed of a liquid separator and a liquid collector which are two separate chambers, and which are connected to each other via a valve, and that for draining of the collected liquid, the liquid collector is connected to the outlet pipe from the processing equipment via an intermediate valve, draining taking place with the aid of compressed gas which via the intermediate valve is supplied from the processing equipment, or alternatively from onshore or a platform, from a gas pipe or a well stream gas pipe on the seabed or the like.

Advantageous embodiments according to the present invention are set forth in the is dependent claims.

In contrast to the prior art, involving draining with the aid of electrically operated pumps or gravity and flushing of sand using liquid delivered from pumps, the requirement for a successful result using compressed gas is, however, that the compressed gas supplied has sufficiently high pressure, more specifically higher than the inlet pressure of the liquid collector during normal operation, i.e., when draining of the liquid collector is not in progress.

Compressed gas may in some instances, as mentioned, be supplied from a platform or onshore, from a gas transport pipe or a transport pipe for well stream gas on the seabed, or from downstream of at least one subsea compressor, or from the intermediate stage of the compressor or from the motor cooling gas.

In the case that the energy is drawn from the compressed gas on the outlet side of the at least one compressor, the compressed gas can be withdrawn both when the compressor is in operation or in the form of confined compressed gas downstream when the compressor is not in operation.

As the object is protection of the compressor, it does not matter in accordance with the present invention what choice is made as regards drive unit or motor, either low-speed or high-speed, and bearings, either oil-lubricated or magnetic bearings, or whether the compressor motor and compressor have gears or not. This is due to the fact that only compressed gas is used, e.g., downstream of the compressor to drain liquid from the liquid collector upstream of the compressor. Moreover, the compressed gas can be used to flush sand from the liquid separator and/or the liquid collector, and also for any other tasks where the use of compressed gas is advantageous. The liquid separator with the associated liquid collector is placed upstream of the compressor to counter erosion and any corrosion due to a higher content of liquid and sand in the gas at the inlet to the compressor than it is designed for.

In cases where several subsea compressors work in parallel with a common manifold, the compressed gas may optionally be taken from or downstream of the manifold.

Although it should not be understood as a limitation, the description of the invention below is given in connection with the draining and/or sand flushing of a subsea liquid collector that collects liquid from an attached liquid separator. Although the positioning as a rule is effected in the form of a subsea location, this must not be regarded as any limitation for the surroundings in which the present device can be placed. It is clear that draining may just as easily relate to liquid which has, for example, collected in the compressor and/or the compressor motor. Furthermore, flushing of sand relates to both the liquid separator and the liquid collector in order to prevent the build-up of sand therein, but can also be used for flushing other components where a build-up of sand might take place.

In practice, the invention is so designed that gas from a pressure source, for example, at least one subsea compressor, functions as a piston that presses down from above, like a piston in a piston pump, whilst a vessel which constitutes the liquid collector functions as a piston cylinder. The design and orientation of the vessel are in principle of no importance, but in practice the most suitable are cylindrical vertical, spherical or cylindrical horizontal.

With regard to flushing so as to remove collected sand, the use of compressed gas causes a powerful swirling because of its pressure and expansion. Positioning of the non-illustrated nozzles and their design can be optimized for the task. The point is therefore that there is plenty of flushing gas under high pressure available for use.

Expansion of gas produces cooling. It must therefore be determined whether the temperature may be so low that there is a danger of hydrate formation. If so, a hydrate-inhibiting agent, e.g., MEG, DEG, TEG, methanol or the like, must be injected in a known way. In most cases the extra addition of a hydrate inhibiting agent is not necessary because it has already been added to the well stream at the start.

An efficient whirling of sand in the liquid collector by compressed gas flushing allows the use of a horizontal separator without any danger of substantial sand accumulation over time. To facilitate the removal of sand, a plurality of liquid outlets can be located along the separator. This is the opposite of the prior art where a vertical liquid separator and collector are used, and the sand out is flushed out using pressurised liquid from a pump, because vertical vessels with one outlet are advantageous when there is a limit to the amount of liquid that can be used for flushing.

The difference in pressure between the compressed gas and the pressure upstream of the subsea liquid separator can also be used for operation of a gas turbine which drives, for example, a pump, an ejector, an eductor and/or a compressor, if such ancillary equipment is regarded as advantageous for draining, flushing out of sand or other purposes. Furthermore, the gas pressure may be used for pneumatic cylinders as actuators for valves and also for pneumatic level measuring or level sensing. For the sake of completeness, the low pressure point may also be the pressure in the liquid separator or downstream thereof, but in the latter case before the pressure boosting equipment.

What makes the present invention different from the prior art is the simplification in that pumps are superfluous and the need for continuous level control in the liquid collector is eliminated. The omission of pumps automatically leads to the advantage that equipment for electric power supply to the pump motor is no longer required. Furthermore, the elimination of continuous level control in the collector leads to a simplification of the control system. The omission of pumps, especially centrifugal pumps, results in the elimination of the need for a specific minimum head of the liquid level in relation to the inlet to the pump, i.e., NPSHR. As mentioned above, this may be, for example, 4 meters. In addition to saved height, it also leads to a reduction in weight and bulk. The removal of equipment, and in particular rotating equipment, will also result in increased reliability.

What allows the elimination of pumps in accordance with the present invention is the utilisation of the energy in the compressed gas supplied, e.g., the difference in pressure between downstream and upstream of the compressor, in order to drain the liquid collector.

The invention requires a supply of gas with a pressure that is sufficiently high with regard to the inlet pressure in the liquid separator, i.e., the gas pressure in the well stream that introduced from the reservoir so that there is enough energy to effect draining and/or flushing. Furthermore, it is presupposed that the components for separation and collection of the liquid are separate chambers each having their respective volume and with one or more valves between these chambers. It is most practical that these chambers are in the form of two separate vessels, for example, cylindrical or spherical, but the two chambers can also be integrated in a common pressure tank with a form of dividing plate between them with a valve inserted therein. In FIGS. 3 to 8, the two chambers are shown as two separate vessels, whilst FIGS. 9A-B show a view with the two chambers in a common vessel with a semi-spherical dividing plate and valve. Other possible embodiments of the dividing plate are, for example, "curved end", flat and conical. The difference between the variants from FIGS. 9 A and B is that the valve with actuator is located outside the actual vessel, which improves the operating environment and simplifies the possibilities for repair, e.g., by replacing the actuator. There is thus the possibility of making the valve separately actuatable by including connectors and manually operated valves towards the liquid separator and the liquid collector respectively. It is also possible to place the valve inside the vessel and the actuator outside.

Note that the dividing plate between the two chambers must be dimensioned as a part of the pressure vessel because it has to withstand the difference in pressure between the chambers during draining, for example, from 5 to 150 bar for respective cases.

Two separate chambers with a valve in between for respectively liquid separation and liquid collection is different from the known solutions where the volume for separation and collection of liquid is formed by a common chamber in a vessel. Reference is made to FIGS. 1 and 2.

Utilisation of the energy in the pressure difference downstream and upstream of a subsea compressor is a realistic possibility because estimates show that the power requirement for pumping for fields of gas and mixture of gas and condensate is very small compared with the power requirement for compression. Table 3 below shows this in figures for typical examples. The power requirement for compression for the example with gas and gas-condensate is approximately 4 000 kW and 10 000 kW, respectively, and estimates shows a power requirement for pumping of respectively 1 kW and 300 kW.

TABLE 3

| | Gas | Gas-condensate |
|---|---|---|
| Pumping power in relation to compression power | 0.03% | 3% |
| Pumping power | 1 kW | 300 kW |

The upsizing of the compressor and its motor to cater for the very modest draining work does not represent an appreciable increase in either the physical dimensions or weight, or the costs for these components. Nor does it represent a noticeable disturbance for operation of the compressor. Choice of correct compressor properties is made so as to ensure that the compressor does not go into current surge when used for draining or flushing.

In subsea compressor stations with large liquid production, it is conceivable that one or more compressors can be especially designated for draining and flushing.

Some subsea compressors use gas from the compressor outlet or intermediate stage for cooling the electric motor and any other components which require cooling, such as any magnetic bearings. The gas used for cooling is typically 1 to 5% of the total gas rate that is compressed, and after the same gas has been used for cooling the motor or other components, it is led back to upstream of the compressor so as to then be capable of being recompressed. Compression power is used to recompress this cooling gas. Consequently, it is advantageous to use the cooling gas for performing the recompression in an optimal manner. It is therefore also very favourable to utilise the cooling gas as compressed gas for the liquid collector as referred to for the present invention.

It may be indicated that for multiphase pumping of a mixture of gas, oil and water, and where the amount of liquid is typically between 5-20% by volume, the portion of the total supplied power to the multiphase pump that is used for liquid pumping is often considerably smaller than the amount used for gas compression, e.g., 20%. Note that the present invention is not useful solely for a stream of gas or a mixture of gas and condensate, but also, for example, for multiphase pumping. The practical question is then whether multiphase pumping according to the invention is more advantageous than conventional multiphase pumping.

Compared to the conventional draining of a subsea liquid separator with an associated liquid collecting volume and the level control when pumps are used for draining, the present invention provides a substantial simplification and also a reduced constructional height.

BRIEF DESCRIPTION OF THE DRAWINGS

The invention will now be explained in more detail with the aid of preferred embodiments that are shown in the drawings, in which.

DETAILED DESCRIPTION OF THE INVENTION

Figure 1:
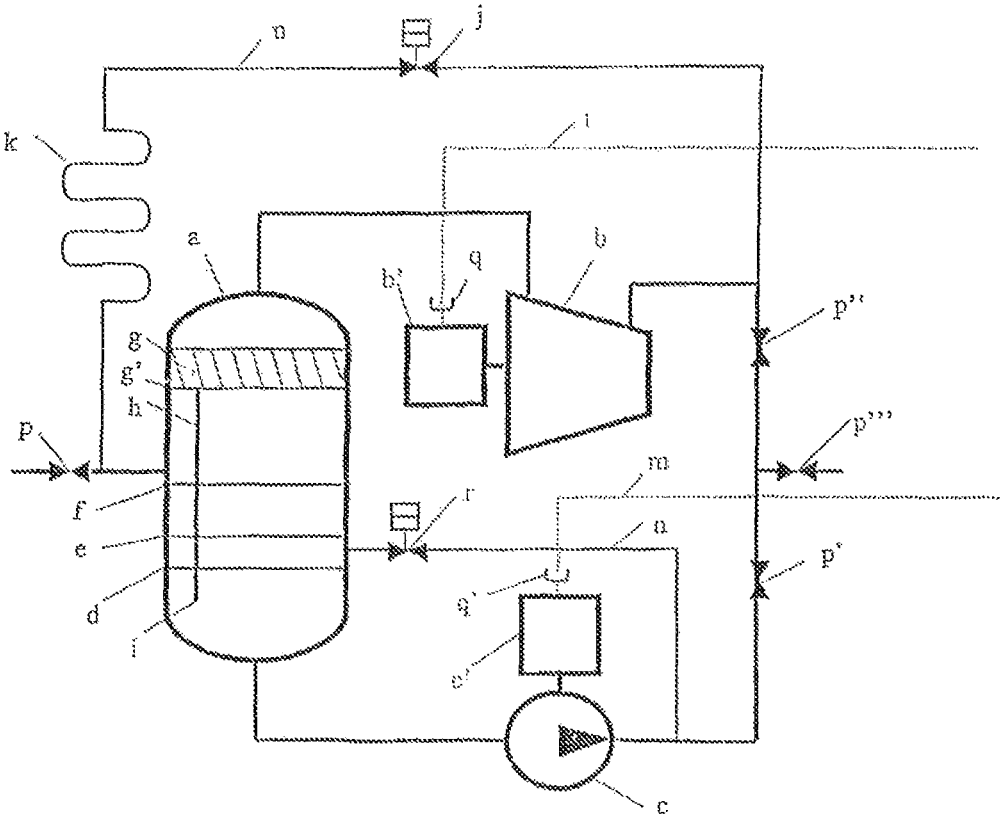
Fig 1 PRIOR ART
FIG. 1 is a schematic illustration of a conventional subsea system for compression of gas.
Figure 2:
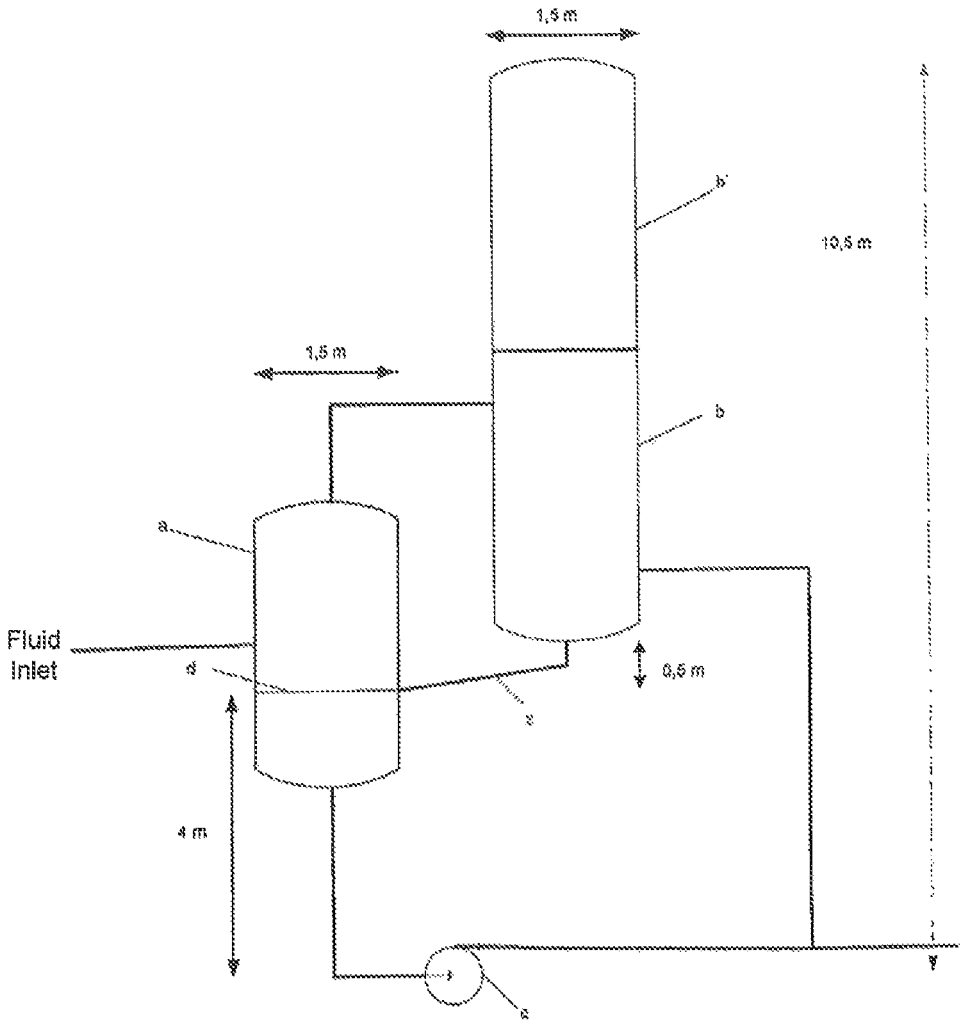
FIG. 2 is a schematic illustration of typical height and diameter for a conventional solution of subsea gas compression with the aid of a compressor, a separator and a centrifugal pump in accordance with the example for gas above (cf. Table 3)

For a clearer understanding of the present invention, reference is made to FIG. 3 and the meaning of the reference numerals can be seen from the list in Table 4 below:

TABLE 4

| | |
|---|---|
| 1 | Liquid separator |
| 2 | Liquid collector |
| 3 | Valve |
| 4 | Valve |
| 5 | Upper level sensor |
| 6 | Valve for compressed gas for draining of the liquid collector |
| 7 | Outlet pipe for liquid |
| 8 | Mixing point for liquid and gas |
| 9 | Choke valve for compressor outlet, may optionally have fixed choking |
| 10 | Lower level sensor |
| 11 | Valve for draining inactive compressor and suitably adjusted choke valve |
| 12 | Valve for inlet to compressor |
| 13 | Drainage valve for liquid from compressor |
| 14 | Compressor motor |
| 15 | Compressor |
| 16 | Valve for flushing gas to liquid separator |
| 17 | Valve for flushing gas to liquid collector |
| 18 | Inlet pipe for wet gas |
| 19 | Outlet pipe for wet gas |
| 20 | Shut-off valve for inlet |
| 21 | Shut-off valve for outlet |
| 22 | Vent pipe |
| 23 | Vent valve |
| 24 | Pipe |
| 25-25''' | Drainage valves for horizontal compressor |
| 26 | Drainage valve for motor of horizontal compressor |
| 30 | Dividing plate |
| 31 | Downpipe from secondary cleaning equipment, for example, cyclones |
| 32 | Valve |
| 33 | Outlet from downpipe |
| 34 | Secondary cleaning equipment |

Note that the equipment included in Table 4 is only that necessary in order to explain the invention and its function. For practical operation, there may in addition be a number of other accessory equipment, such as non-return valves, pressure and temperature sensors etc.

It should otherwise be noted that even though illustrations of the invention are given in connection with a liquid collector and a liquid separator which, in an appropriate manner, are attached to a compressor and a compressor motor, these being arranged in a common pressure shell, this does not by any means involve a limitation of the present invention. Thus, it should simply be understood that the invention is useful for any processing equipment for gas, where a liquid separator and an associated liquid collector are included. If the processing equipment involved, for example, is not capable of delivering compressed gas with sufficiently high pressure, or for some reason it is not desirable to use such supply, the compressed gas can instead come from onshore or a platform, or from a gas pipe on the seabed or a well stream gas pipe on the seabed or the like.

In this case, the liquid separator 1 is equipped with non-illustrated secondary cleaning equipment for catching droplets, e.g., multicyclones, in a separate vessel independent of the liquid collector 2. The height of the liquid separator is basically determined by practical factors, such as there having to be room for an inlet and optional inlet equipment for pulse damping and pre-separation of liquid in the inlet, and the height of the secondary cleaning equipment plus a certain minimum distance between the inlet of the inlet and secondary cleaning equipment. In practice, the overall height is kept within, for example, 2.5 to 4 meters.

If the secondary cleaning equipment consists of cyclones or the like with relatively high drop in pressure, which requires a downpipe 31, this downpipe must be passed from the liquid separator 1 to the liquid collector 2. Furthermore, an outlet 33 from the downpipe 31 is positioned so that it is always below the lower liquid level in the liquid collector, i.e., has a submerged outlet. This lower level is determined by a lower level sensor 10.

Moreover, the liquid separator 1 must have a sufficient volume for collecting liquid, i.e., an average production of liquid and any liquid slugs, whilst the liquid collector 2 is drained and the valve 3 is closed. During normal operation, the liquid separator 1 is at all times almost empty because liquid and any sand flows down to the liquid collector 2 as a result of the valve 3 between them being open and the valve 4 in the drainage end of the liquid collector 2 being closed. The volume of the liquid collector 2 is dimensioned on the basis of a practical balance between having such a large volume that it does not have to be drained "all the time", for example, every minute, and at the same time not having such a large volume with associated dimensions and weight that it is impractical and unmanageable. In the example above with a liquid production of 10 $m^3$/day, a volume of 3.5 $m^3$, for instance, gives about three draining operations a day. Associated dimensions may be a diameter and a height of 1.5 meters and 2 meters respectively.

Figure 3A:
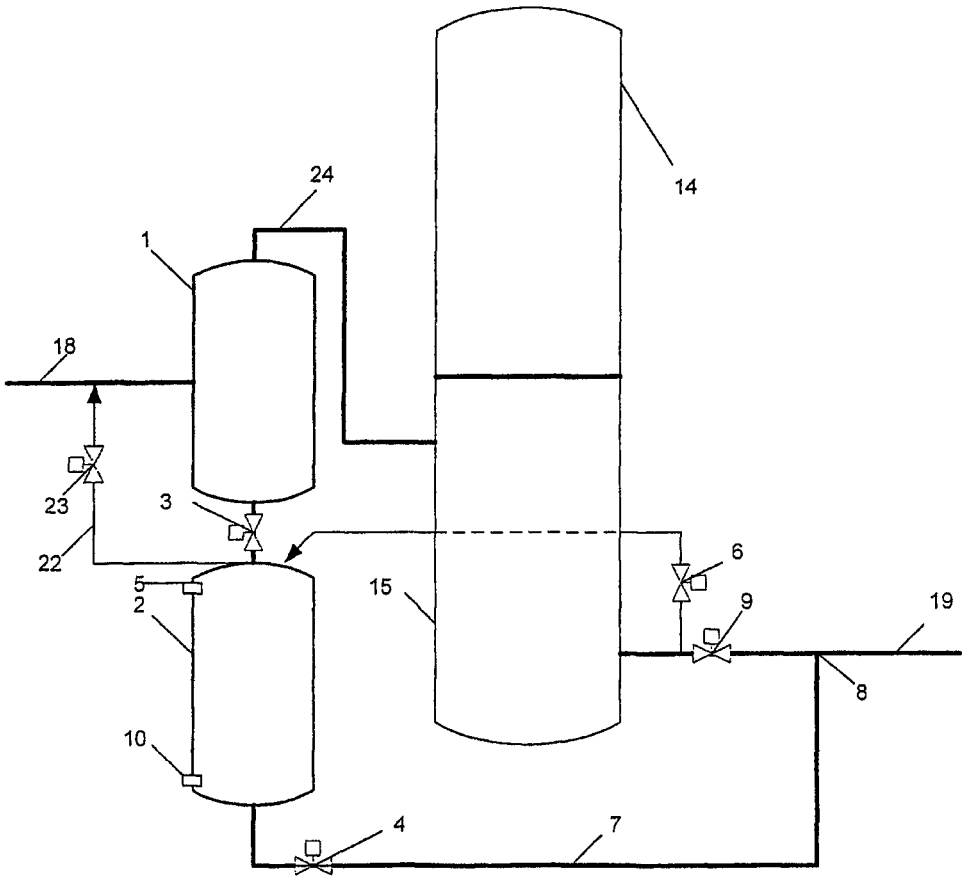
FIGS. 3A to 7 show schematic embodiments according to the present invention of a liquid collector and an associated liquid separator in order to explain respectively draining of the liquid collector, sand flushing of the liquid separator and the liquid collector, which may be carried out independently of each other, simultaneous sand flushing of the liquid separator and the liquid collector, draining of a vertical compressor motor and compressor, the difference between FIGS. 6A and 6B being the location of an outlet point for compressed gas in relation to a shut-off valve, and draining of a horizontal compressor motor and compressor, for the sake of clarity only shown with pipes and valves that are of importance for the draining of the liquid collector.

Reference is now made to FIG. 3A for an explanation below of the draining of the liquid collector 2, in the case where the secondary cleaning equipment is of a type that does not require a downpipe.

When so much liquid has been collected in the liquid separator 2 that the upper level is reached, a level sensor 5 gives a signal that triggers the following draining sequence:

- the valve 3 is closed;
- the valve 6 is opened so that the liquid collector 2 is pressured up to the compressor outlet pressure by the compressed gas supplied; and
- the valve 4 is opened and the liquid collector 2 is drained via the outlet pipe 7.

Draining takes place to a lower level which is normally an empty tank. A level sensor 10 at the bottom of the liquid collector 2 or in its outlet pipe 7 triggers a stoppage in the draining. It is conceivable that this is done in that the supply of compressed gas via the valve 6 is stopped at the same time as the valve 4 is closed and the valve 3 is opened. The sequence of the manipulation of the valves 4 and 6 is of no consequence because the pressure will be the same on either side of the valve 4 in any case. With such a simple method, which can be used in certain cases, two problems may arise:

- Because of the difference in pressure between the liquid collector 2 and the liquid separator 1, which is quite substantial, for example, from 5 to 100 bar, it may prove difficult to open the valve 3.
- A pressure and volume surge may occur in the liquid separator 1 when the valve 3 is opened, disturbing the liquid separation. In the worst case, liquid that has been collected in the liquid separator 1 whilst the liquid collector 2 is being drained, is blown through the liquid collector 2 and into the compressor 15 with possible adverse consequences.

Whether this simple procedure to return to normal operations after completed draining can be used must be evaluated in each individual case. It depends, inter alia, on how great the liquid production is in relation to the draining time, in other words, how much liquid may have collected in the liquid separator whilst draining is in progress, and it depends on the pressure difference between the liquid collector 2 and the liquid separator 1 on completed draining when the valve 3 is opened. In the example above with a liquid production of 10 $m^3$/day where the difference in pressure in 30 bar and an estimated draining time is 0.5 minutes, the amount of liquid collected in the draining time is about 0.4 liters, which may be acceptable.

To avoid the risk associated with the simple procedure above, it is preferred that the arrangement includes a vent pipe 22 with a valve 23, see, e.g., FIG. 3A. A preferred procedure after completed draining is then:

The valves 6, 4 are closed.

The valve 23 is opened and kept open until sufficient pressure equalisation has been obtained between the liquid collector 2 and the liquid separator 1. The time depends in particular on the diameter of the pipe 22, and may in practice be, for instance, from a few seconds to 1 minute or more.

The valve 3 is opened and valve 23 is closed. A return to normal operating conditions then takes place until the next draining.

It should be pointed out that with the preferred procedure all the valves that are moved by a high difference in pressure, i.e., the valves 23, 6, have a small diameter, for instance in the range of about 25 to 50 mm, which does not cause any problems. The large valve 4 is opened and closed without any difference in pressure, independent of whether the simple or the preferred procedure is used. This is because the liquid collector 2 is filled after the valve 3 has been closed and the valve 6 then opened, up to the same pressure as downstream of the valve 4 before it is opened. After draining has been completed, the valve 4 is also closed before the pressure is released from the liquid collector 2. As already mentioned, the valve 3, when opened in accordance with the simple procedure, must be opened with full difference in pressure between the liquid collector 2 and the liquid separator 1. With the preferred procedure, the difference in pressure between the liquid collector 2 and the liquid separator 1 is neutralised fully or sufficiently before the valve 3 is opened.

As for the example shown in FIG. 3A, an outlet pipe 7 for liquid from the liquid collector 2 opens into a mixing point 8 in a gas outlet pipe 19 from the processing equipment. Alternatively, the liquid that is drained may of course, in a non-illustrated way, be passed to another receiving point, e.g., onshore or on a platform etc.

If feasible as regards function, wear and reliability, the valves 3, 4, with the preferred procedure, may in principle be non-return valves. The valve 3 then closes when compressed gas flows via the valve 6 into the liquid collector 2, and the valve 4 opens.

As regards determining whether the difference in pressure between the liquid collector 2 and the liquid separator 1 is sufficiently or fully neutralised, this can simply be done by keeping the valve 23 open for a time determined by calculation. This is because such calculation is simple. Optionally, a pressure sensor can be installed in the liquid collector 2 and the pressure here compared with the pressure in the liquid separator 1, the measured difference in pressure determining when the valve 3 can be opened. A pressure sensor can also be installed in the liquid separator 1, but normally pressure sensors are installed in proximity of the liquid separator 1, which for the purpose provides a good enough indication to determine the pressure in the liquid separator 1.

Instead of sensors for determining the upper and the lower level, continuous measurement or sensing can be used. Such measurement or sensing of an upper and lower level can also be replaced, if so desired, by a time control of the draining based on experience or calculation. Combinations thereof may also be used.

During draining, the valves must be controlled so that compressed gas that is supplied from the compressor 15 via the valve 6 cannot flow in the wrong direction, i.e., upwards through the valve 3, and disturb the operation of the liquid separator 1. Consequently, the valve 3 must be closed before the valve 6 is opened, and the valve 4 is opened after the valve 3 has been closed and the liquid collector 2 has been pressurised.

The possibility of draining and at what speed is determined by a number of factors. If the liquid collector 2 is fed via the valve 6 at the outlet pressure of the compressor 15, the liquid collector 2, which is required to have a head, is drained to the mixing point 8 for liquid and gas by gravity, until the vessel in the liquid collector 2 and optionally the pipe 7 have been emptied after a certain time.

Figure 3B:
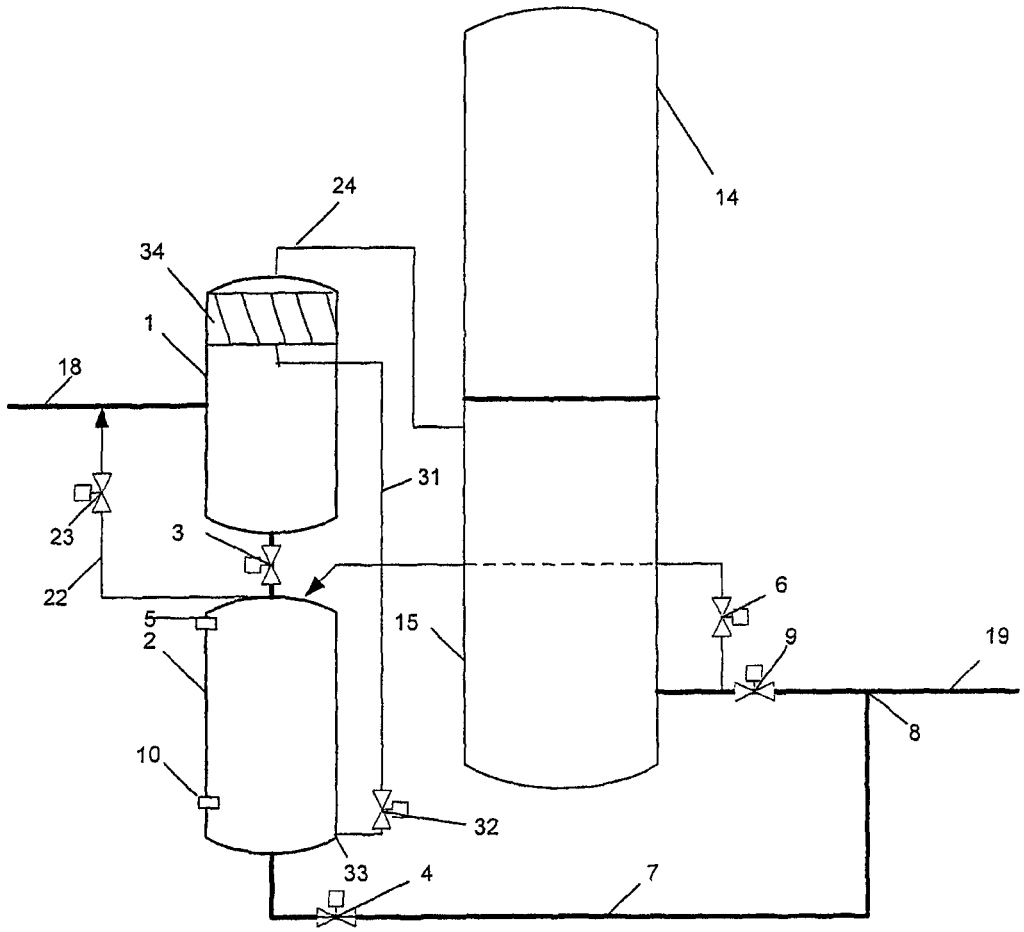

With reference to FIG. 3B, there now follows an explanation of the draining of the liquid collector 2 when the secondary cleaning equipment requires a downpipe 31 with a valve 32 and a submerged outlet 33. Only the differences from the description related to FIG. 3A are explained.

During normal operation, the valve 32 in the downpipe 31 is open so that liquid that is separated by the secondary cleaning equipment flows down the downpipe 31 and into the liquid collector 2 from the outlet 33 which is submerged and thus below the lower level sensor 10.

During draining of the liquid collector 2, the valve 32 is closed. Liquid which is then separated in the secondary cleaning equipment is collected in the downpipe 31 above the valve 32. From a purely practical point of view, the valve 32 should be placed as low as possible so as to provide maximum collecting volume in the downpipe 31. The diameter of the downpipe must, inter alia, be based on calculations of the collected liquid volume. A diameter of 50 to 75 mm will in most cases probably be sufficient. By following the procedure for respectively the start of draining and the end of draining, as described in connection with FIG. 3A, the opening and closing of the valve 32 takes place with little or no difference in pressure.

Otherwise, draining of the liquid collector 2 in any of the cases from FIGS. 3A and 3B can be boosted and the need for head can be reduced or eliminated with regard to the mixing point 8 in the following ways:

1. The choke valve 9 is set for appropriate choking to obtain a desired overpressure in the liquid separator 1 in relation to the pressure at the mixing point 8. If this overpressure, for example, is 0.5 bar, it corresponds to a physical head of about 5 meters. By choking more, the required physical head for the liquid collector 2 to the mixing point 8 cannot only be reduced, but eliminated completely, if considered advantageous. If desired, the liquid collector 2 can be placed below the mixing point 8 by adjusting the head in the liquid separator 1 by restricting flow using the choke valve 9. A choking of, for example, 2 bar corresponds to a physical head of about 20 meters. The method involving choking of the outlet therefore gives a greater degree of freedom as regards the height location of the liquid separator 1 and liquid collector 2. Such a choke valve may have only two positions, i.e., an open and a certain choking position, or is alternatively adjustable to be able to adjust the choking if so desired. If frequent draining is necessary, the choke valve can be replaced by a fixed choke.

2. Extra pressure can be obtained by equipping the compressor with an extra impeller after its last normal stage. Usually the compressed gas passes from this stage to the suction side, but a valve arrangement can guide it to draining and optional flushing.

It should also be mentioned that gas for flushing may not only be taken from the outlet of the compressor 15 for supply via the valve 6, but may in addition be taken from any one of the compressor stages, not shown in the drawings. The same may apply to draining when this provides sufficient pressure to drain, e.g., in combination with a physical head or choking of the choke valve 9 or with an extra impeller in the compressor.

In addition, it should be mentioned, as is known, that the compressor motor 14 can be cooled in that a suitable amount of gas from one of the stages of the compressor 15 is conducted through the motor for taking up heat, not shown. This cooling gas can also be passed for use as flushing gas or optionally for draining.

Draining of a subsea compressor motor and compressor is advantageous immediately after installation because seawater may have penetrated during the installation procedure on the seabed. After a shutdown it may also be advantageous to drain the compressor motor and the compressor before they are put into operation again.

Figure 4:
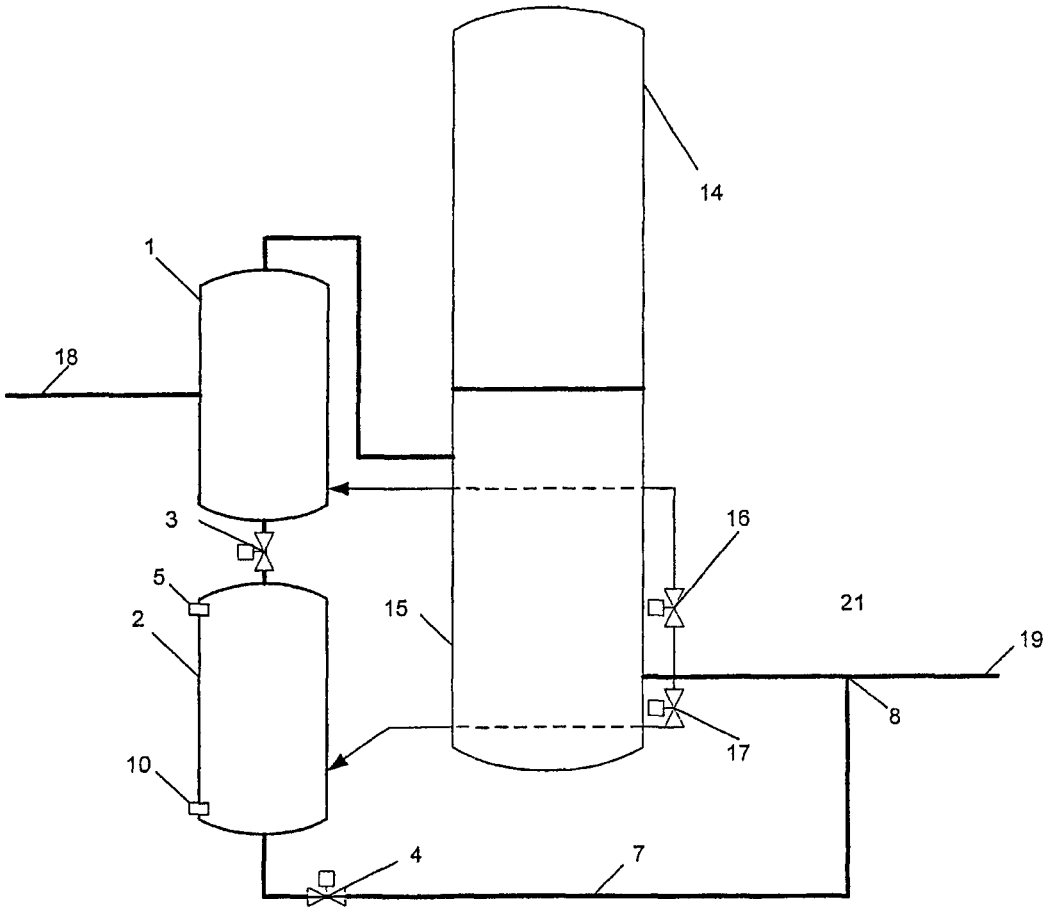
Figure 5:
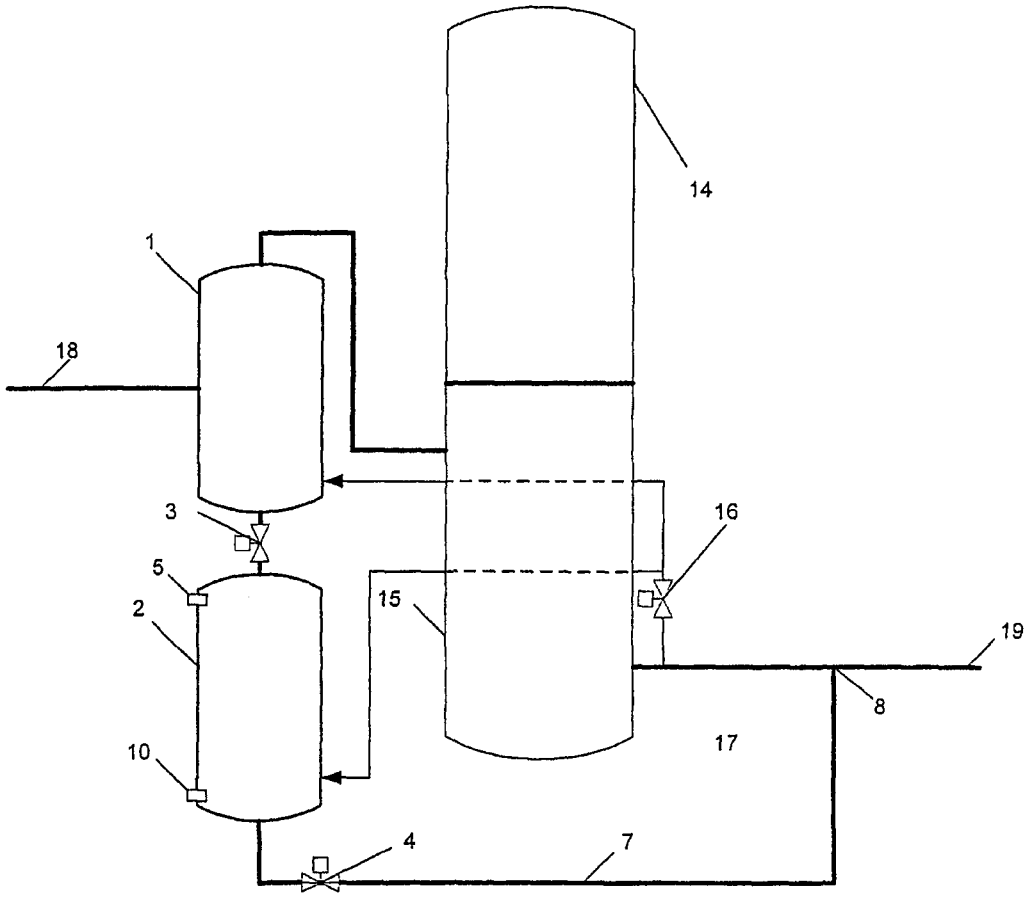

Reference is made to FIGS. 4 and 5 in order, in what follows, to explain sand flushing of the liquid separator 1 and the liquid collector 2.

During flushing of the liquid separator 1, the valves 16 are opened and during flushing of the liquid collector 2 the valve 17 is opened. Flushing can be time-controlled based on experience or calculated flushing requirement to prevent a build-up of sand, or optionally by forms of measurement or indication of a build-up of sand. As explained in connection with the figure, the liquid separator 1 and the liquid collector 2 are flushed independently of each other. With the two valves 16, 17, the flushing frequency for respectively the liquid separator 1 and the liquid collector 2 can take place independently of one another.

FIG. 5 shows a simplified arrangement where sand flushing takes place at the same time in the liquid separator 1 and the liquid collector 2. In such a case, one of the valves can be removed so that only the valve 16 is kept. Flushing gas is fed simultaneously to the liquid separator 1 and the liquid collector 2. For the majority of cases, the method with a common flushing valve is probably satisfactory. The flushing gas supply to the liquid separator 1 must be adapted so that it does not significantly disturb the separating out of the liquid.

Figure 6A:
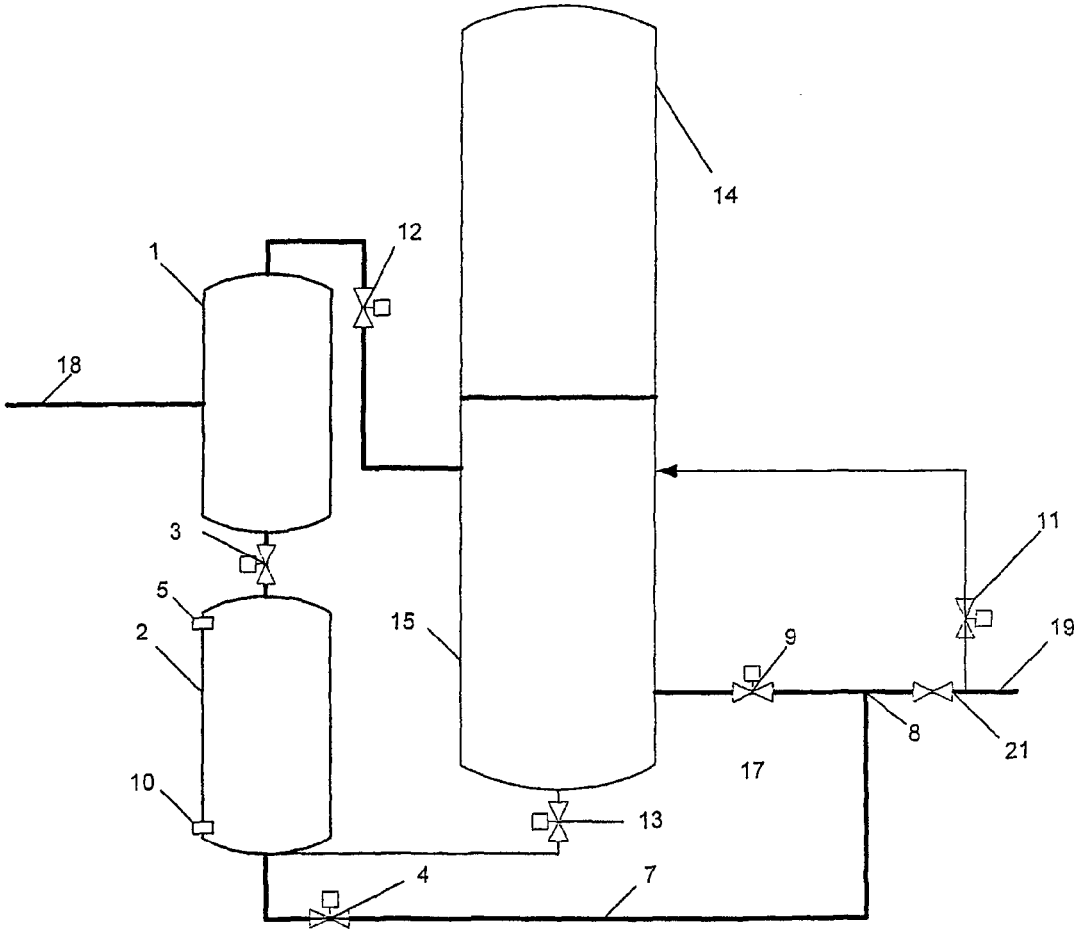
Figure 6B:
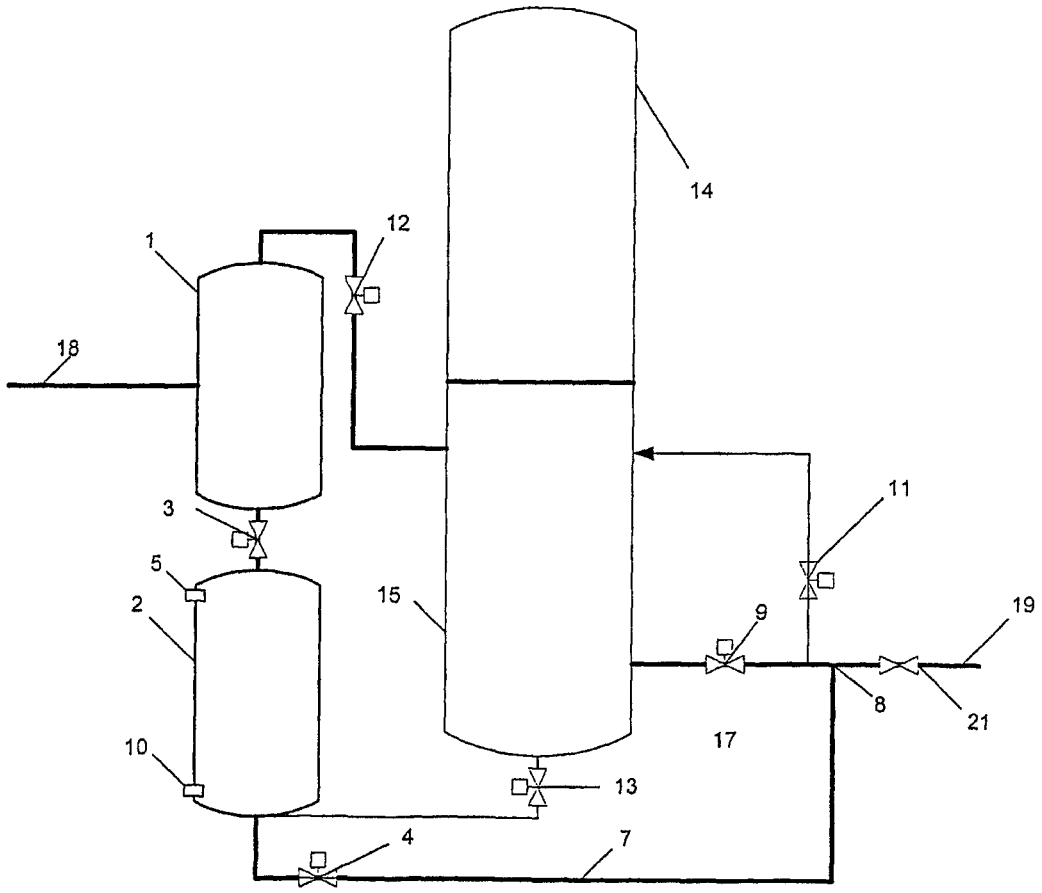

FIGS. 6A and B show draining of a vertical compressor and compressor motor 14, 15. The difference between the two figures is the outlet point for drainage gas via the valve 11. Liquid which has been collected is drained in that compressed gas is admitted into the compressor and the compressor motor when the valve 11 is open. The compressor is then not in operation and the valve 12 is closed, as is a shut-off valve 21 and the anti-surge valve, not shown here, but reference is made to the valve j, in FIG. 1. A closed anti-surge valve is a requirement also for the draining procedures of the compressor motor and the compressor which follow. In this way, a suitable amount of gas for draining of the compressor motor and the compressor can be metered, so that it does not result in harmful backflow, i.e., such a large amount of gas that a harmful backward rotation or other adverse effects occur. An alternative way of draining the compressor is that the shut-off valve 21 is opened and the compressor motor and compressor receive full pressure from the outlet pipe 19, optionally in combination with choking of the valve 9 to avoid harmful high backflow. A further alternative is that the valve 21 is opened, then the valve 9 is fully open or does not exist, at the same time as the valves 3, 4, 12 are closed. Then the backflow of drainage gas is reduced and stops completely when the confined volume has acquired the same pressure as the feed pressure, i.e., the pressure in the outlet pipe 19. When assessing the size of harmful backflow, it must be taken into account that the draining procedure is brief, normally seconds. The main point is that the pressure in the pipe/pipe system downstream of the compressor is utilised for draining.

In a compression system with only one compressor and no difference in pressure between outlet 19 and inlet 18 before start-up, compressed gas for draining must be supplied in another way, not shown in the figures. One way is that the compressor motor 14 and the compressor 15 are filled with an inert gas, for example, nitrogen at high pressure, i.e., higher pressure than in the pipe 19 and hence in the liquid collector 2 during installation. This overpressure can then be used to drain the compressor 15 and the compressor motor 14 to the liquid collector 2. Alternatively or as a back-up solution, a remote-operated subsea vehicle (ROV), for example, can supply gas either via a hose or from pressure gas cylinders.

Figure 7:
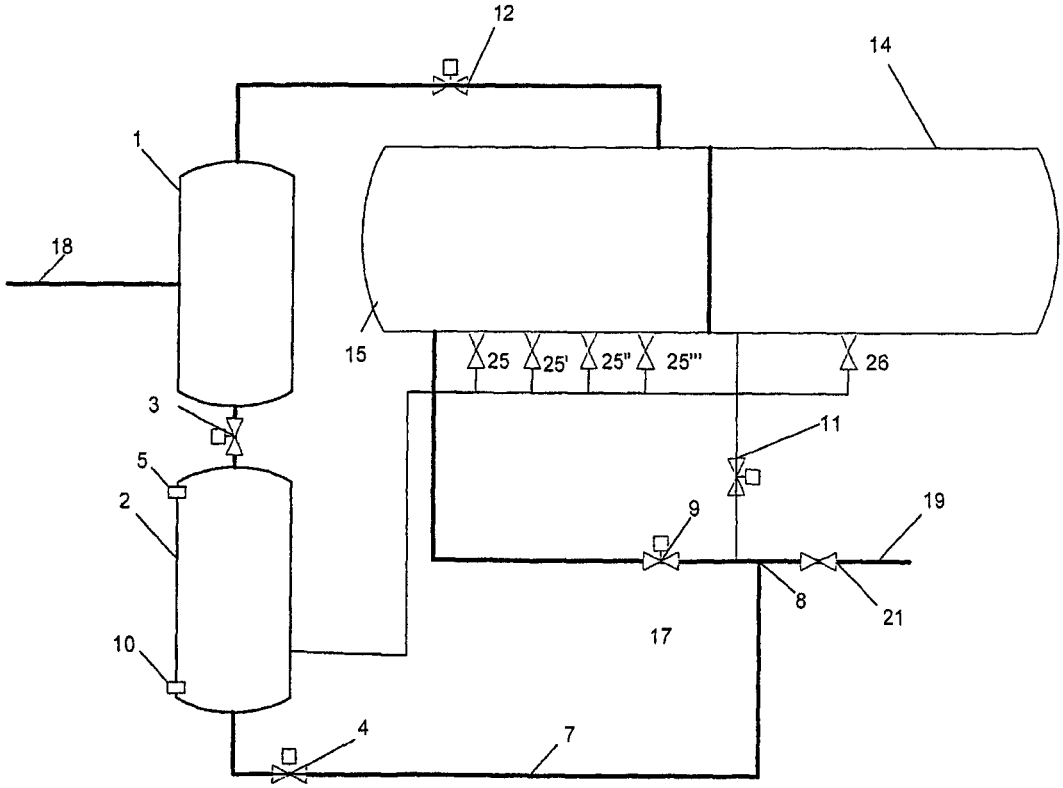

FIG. 7 shows draining of a horizontal compressor and compressor motor 14, 15. This draining differs from draining in the vertical variant where only one drainage outlet is necessary, in that liquid in the case of the horizontal position does not run down and collect in one volume at the bottom of the compressor. Here, it is therefore necessary to have several drainage points. It is probably advantageous to have draining from each stage in the compressor 15 and at least one point for the compressor motor 14. If, for example, the compressor has four stages, five outlets for drainage pipes with corresponding valves 25, 25', 25", 25'", 26 are required which must be operated either by a ROV or remote control. Because draining takes place infrequently, probably only once after each installation, this is not a major drawback for the horizontal arrangement. In other respects the same method applies as for the vertical compressor motor and compressor 14, 15.

Figure 8:
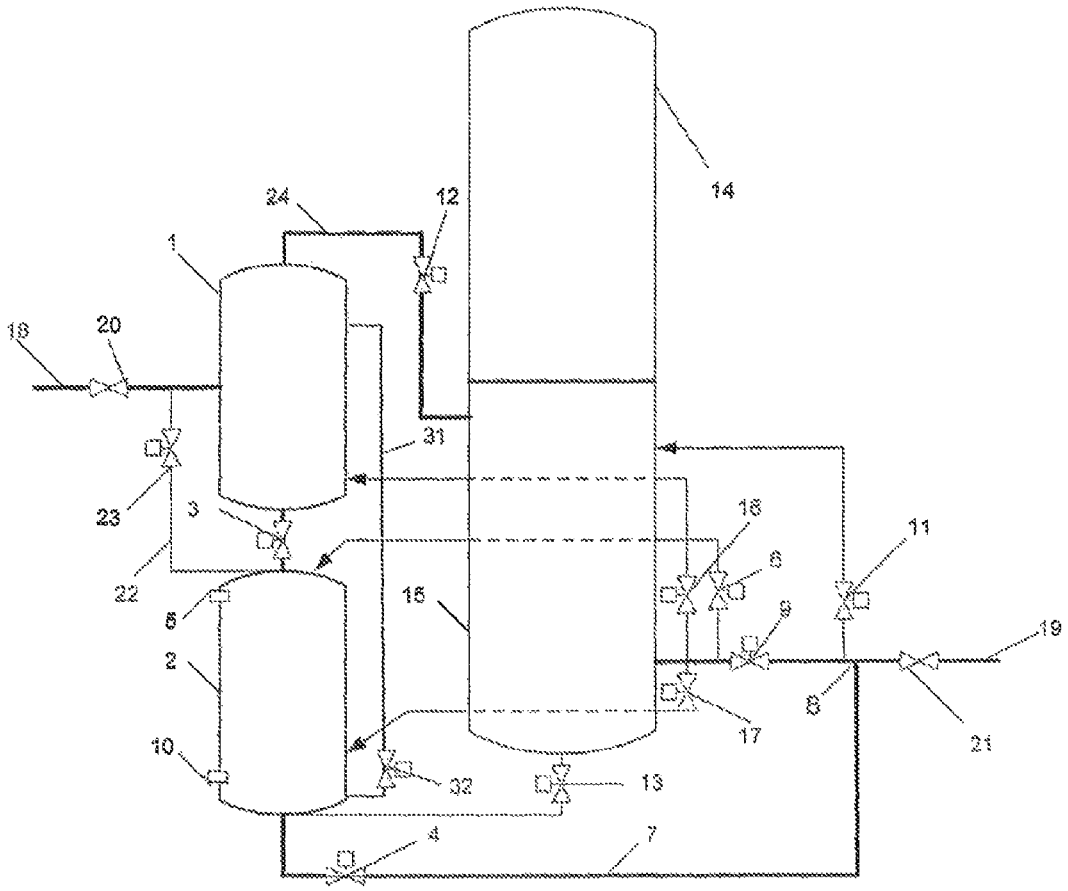
FIG. 8 is a schematic illustration of the present invention where all pipes and valves from FIGS. 3 to 7 are included in the drawing.

In FIG. 8, to give a full overview, all the valves in FIGS. 3 to 6 have been included in the drawing. This does not mean that a respective embodiment must have all these valves, but an appropriate selection depending on how draining and flushing is to be carried out.

Figure 9A:
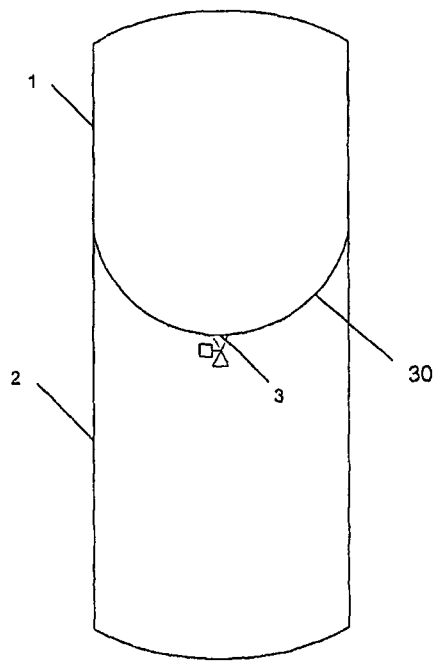
FIGS. 9A-9B are schematic illustrations of a solution where the chamber for the liquid separator and the chamber for the liquid collector are integrated in a common vessel with a dividing plate and an associated valve between the two chambers.
Figure 9B:
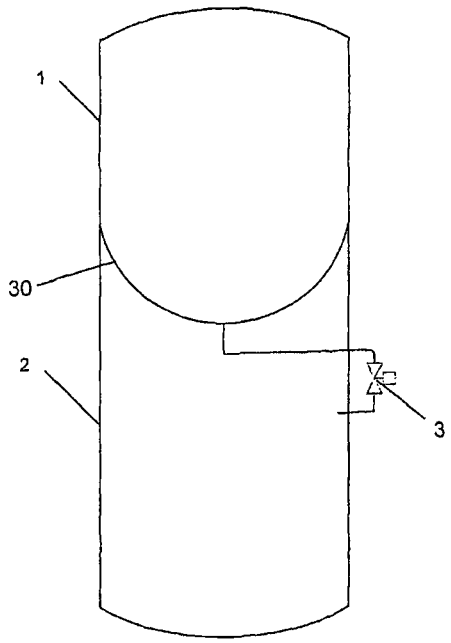

FIG. 9 shows a solution where the liquid separator 1 and liquid collector 2 are integrated in a common vessel with an intermediate dividing plate 30 which, in this example, is in the form of a semi-spherical element with an inserted valve 3. The dividing plate must be constructed to withstand maximum pressure difference in the chamber 1, 2 for respectively the separation and collection of liquid. It will be understood that the dividing plate 20 is not limited to the illustrated design, but may have any other suitable design.

In addition to the invention giving freedom of choice as regards height location, it also allows the liquid separator 1 and the liquid collector 2 to be placed at any distance from the mixing point 8, inasmuch as adjusting the difference in pressure between the interior of the liquid collector during draining and the mixing point can compensate for higher friction loss in the pipe 7 which leads from the liquid collector to the mixing point, optionally that the liquid is passed in a separate pipe to the receiving point. As pointed out above, this compensation can be effected by setting the choking above the valve 9 or by the pressure from an extra impeller in the compressor 15, or a combination thereof.

Furthermore, draining and flushing with compressed gas allows use of a liquid collector that is horizontal or spherical, or in principle of any shape, which is also advantageous for a compressor motor and compressor that is arranged in a horizontal direction. It is otherwise not discussed or shown in more detail how compressed gas can be supplied from another source than from the pipe 19 downstream of the compressor, as is mentioned above. This is because there are many possibilities and it is regarded as sufficient only to mention that the compressed gas can be supplied directly via the intermediate valve 6 or in a pipe section preferably ahead of this.

In the case of a liquid separator 1 and a liquid collector 2 that are located upstream of the compressor motor and the compressor 14, 15, one consequence of the invention is that the overall arrangement of the components can be made compact. Draining of the compressor 15 and its motor 14 with compressed gas also reduces the need for height. This means that the combination of liquid separator 1 and liquid collector 2 and height location of these two can be made so that their height does not exceed the height of the vertical compressor arrangement which thus determines the overall height of the arrangement. The explanation is that the pump requiring NPSHR is eliminated. Because the pump is omitted, the space requirement is also reduced. As the reliability of the liquid separator 1 and the liquid collector 2 is great in comparison with the compressor motor and compressor 14, 15, and moreover the weight of the two first-mentioned is small compared to the two last-mentioned, the choice may be made not to have a mechanical connector between these components. Thus there are only two mechanical pipe connectors, one on the inlet pipe 18 and one on the outlet pipe 19. These may in a known way be combined into one connector with two passages, which will give a further reduction in weight and complexity. This contributes to compactness and weight reduction.

Figure 10:
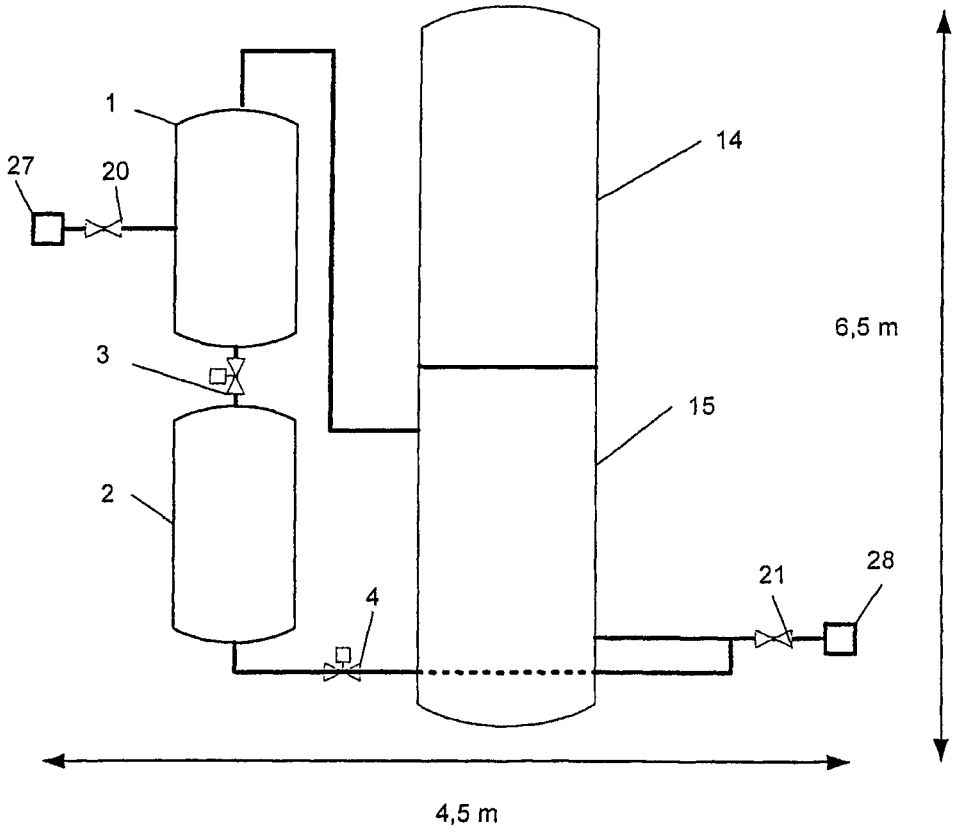
FIGS. 10 to 12 are schematic illustrations of respectively a vertical and a horizontal arrangement in accordance with the present invention to illustrate the space requirement in the respective direction.

As there is no pump with associated motor, there is only need for one electrical high voltage connector, i.e., to the compressor. Consequently, a single compact arrangement can be made for a subsea pressure boosting unit for well stream gas with low weight and small dimensions. In FIG. 10 this is shown schematically with the dimensioning main components for vertically arranged compressor motor and compressor 14, 15 for an example with gas. In such a case the approximate dimensions for a template with pressure booster are:

Length: 4.5 meters

Width: 4 meters

Height: 7 meters, height of the compressor and its motor approx. 6 meters plus extra for template etc.

As regards the width, this is produced by the width of the compressor motor and compressor, 1.5 meters, plus space for an anti-surge cooler, a motor cooler, control units and other ancillary equipment not shown in the figure, as only equipment crucial for the main dimensions is shown.

Figure 11:
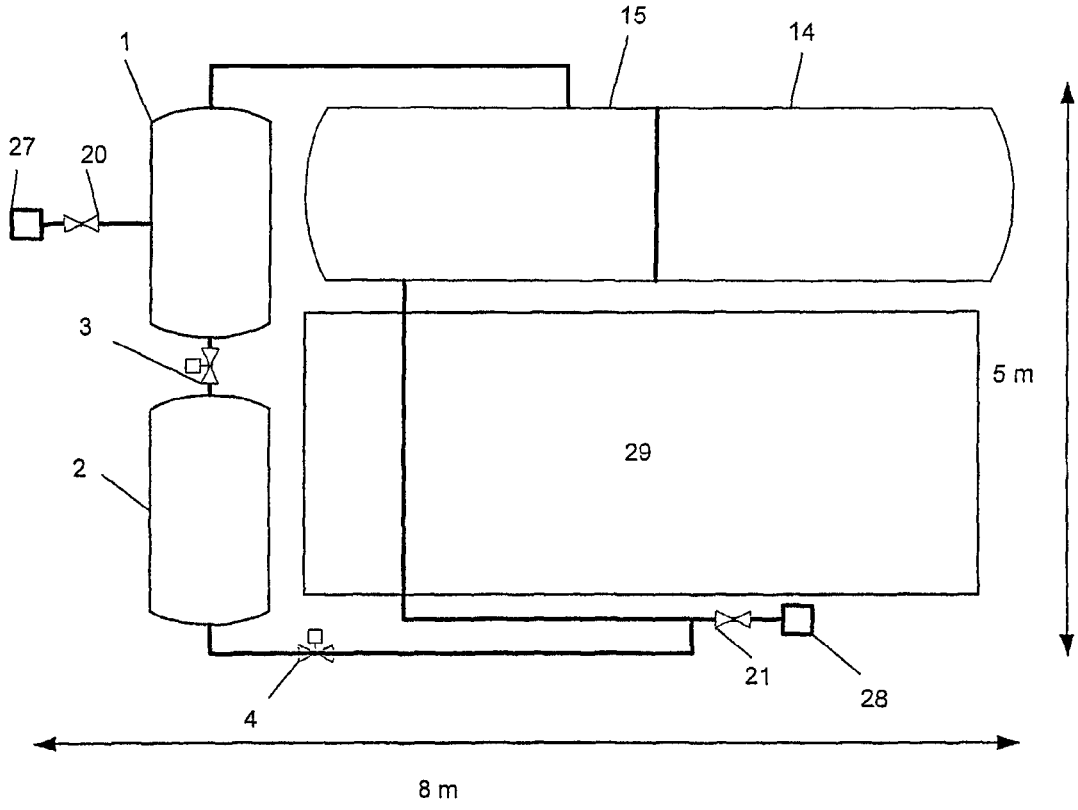

A similar possible arrangement for a horizontal arrangement of the compressor motor and the compressor 14, 15 is shown in FIG. 11.

As already mentioned above, in addition to the small dimensions, the weight is low. For the example above, it is about 100 tonnes. The high reliability is also important.

The suggested dimensions and weight indicate a unit that can easily be installed and retrieved for maintenance.

To facilitate the understanding of FIGS. 10 and 11, the meanings of the reference numerals that come in addition to Table 4 are shown in Table 5

TABLE 5

| | |
|---|---|
| 27 | Mechanical connector for inlet to the liquid separator |
| 28 | Mechanical connector for outlet from the compressor |
| 29 | Space for coolers, inspection tanks and other equipment |

Figure 12:
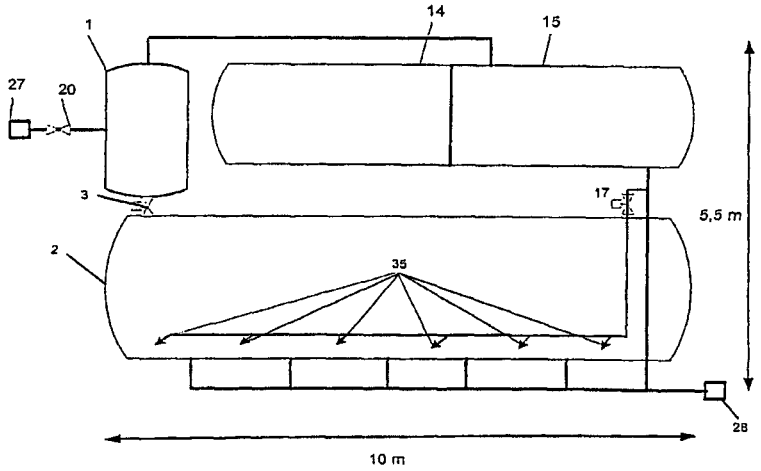

In FIG. 12 the main dimensions for the example with gas-condensate with a horizontal separator and compressor with motor are shown. In this case, the compressor motor 14 has an output of 10 MW and liquid production is 40 $m^3$/hour. The total length of the compressor and compressor motor is 8 meters and their diameter is 1.5 meters. For the liquid collector there has been chosen a diameter of 2.8 meters and a length of 8 meters which results in a collecting volume of about 50 $m^3$, which allows a time lapse between each draining of about 1 hour. The draining time is estimated to be about 1.5 minutes at 2 bar overpressure. In addition to the previously listed reference numerals, FIG. 12 shows nozzles 35 for flushing of sand.

For the sake of completeness, it should also be pointed out that the power supply to the compressor motor 14 may need more or less seabed-located equipment for the supply of electric power. The scope of the equipment required depends on the distance from the point for power supply. Without precisely defining the terms short, medium and long distance, the scope of the seabed-located equipment for electric power supply may be suggested as follows:

Short distance: None

Medium distance: Transformer

Long distance: Transformer and frequency converter for controlling the rotational speed of the compressor motor and compressor as required.

In the case of medium distance, the transformer can simply be placed within the dimensions that have been suggested above and without any weight increase of significance. The reliability is also not affected to any appreciable degree.

At a long distance, it must be evaluated in the case concerned whether the frequency converter should be placed on the same or a separate template. It is probably best to place the frequency converter on a separate template together with transformers and that the cable with electric power runs from this separately actuatable electrical equipment unit.

In case it has not already been clearly mentioned above, the processing equipment is a compressor 15 with a motor 14. The draining and flushing function for the liquid collector 2 is combined and its compressed gas is supplied from the gas outlet pipe 19 via a valve 6, 17. The choke is fixed. The outlet pipe opens into the mixing point in the fixed choke. The fixed choke has a converging and a diverging part and the outlet pipe 7 opens into the mixing point 8 between the converging and the diverging part. The valves 3, 4 are non-return valves, like the valve 32. A vent pipe 22 with a shut-off valve 23 is arranged between the liquid collector 2 and the liquid separator 1 or the inlet pipe 18 to the liquid separator 1. The shut-off valve 23 is closed during normal operation and during draining of the liquid collector 2 and open for a certain time after draining in order to obtain pressure equalisation between the liquid separator 1 and the liquid collector 2. The valve 23 is a non-return valve.

Lastly, it should be mentioned that if there are several subsea pressure boosters working in parallel and which receive electric power through a common cable, it is necessary to have an electric circuit breaker for the electrical equipment.

The invention claimed is:

1. A device for separating and collecting liquid entrained in gas from a reservoir, which device is attached to processing equipment for gas, said gas being delivered to the processing equipment from the device via an inlet pipe to the processing equipment and the collected liquid being removed periodically from the device via a liquid outlet pipe, the device comprising a liquid separator and a liquid collector which are two separate chambers, and which are connected to each other via a valve, and that for draining of the collected liquid, the liquid collector is connected to a gas outlet pipe from the processing equipment via an intermediate valve, draining taking place with the aid of compressed gas which via the intermediate valve is supplied from the processing equipment, or alternatively from onshore or a platform, from a gas pipe or a well stream gas pipe on the seabed.

2. The device according to claim 1, wherein when secondary cleaning equipment in the form of cyclones is used in the liquid separator, a downpipe is provided in connection with the secondary cleaning equipment and opens into a position below a lower level sensor in the liquid collector.

3. The device according to claim 2, wherein during draining of the liquid collector, the downpipe is shut off by a downpipe valve.

4. The device according to claim 3, wherein the downpipe valve is arranged in a lower end of the downpipe.

5. The device according to claim 1, wherein for flushing to remove sand and/or other particles, the liquid collector and/or the liquid separator is connected to the gas outlet pipe via at least one flushing valve, flushing taking place by using compressed gas which via the at least one flushing valve is supplied from the processing equipment, or alternatively from onshore or a platform, from a gas pipe or a well stream gas pipe on the seabed.

6. The device according to claim 1, wherein for flushing to remove sand or other particles, the liquid separator is connected to the gas outlet pipe via a flushing valve, flushing being carried out with the aid of compressed gas which is supplied via the flushing valve from the processing equipment, or alternatively compressed gas from onshore or a platform, from a gas pipe or a well stream gas pipe on the seabed, or alternatively from any intermediate stage in the processing equipment or from cooling gas from the processing equipment.

7. The device according to claim 1, wherein a shut-off valve is arranged in the liquid outlet pipe.

8. The device according to claim 1, wherein the outlet pipe opens into a mixing point in the gas outlet pipe for gas from the processing equipment.

9. The device according to claim 1, wherein the liquid outlet pipe opens into a receiving point onshore, on a platform, back to the reservoir.

10. The device according to claim 1, wherein for boosting the draining, a choke valve is arranged in the gas outlet pipe from the processing equipment in a position ahead of a mixing point for liquid and gas and also after a take-off point for the intermediate valve.

11. The device according to claim 1, wherein the liquid separator and the liquid collector are in the form of two physically separate vessels.

12. The device according to claim 1, wherein the liquid separator and the liquid collector are arranged in a single vessel, their physical separation being in the form of an intermediate dividing plate equipped with the valve.

13. The device according to claim 1, wherein draining is controlled with the aid of an upper and a lower level sensor which are arranged in the liquid collector.

14. The device according to claim 1, wherein draining is time-controlled based on experience or calculation.

15. The device according to claim 1, wherein the processing equipment is in the form of a compressor and a compressor motor which are arranged in a common pressure shell, and for boosting the draining, the compressor is equipped with an extra stage so as to cause a similar boost in the drainage gas pressure.

16. The device according to claim 15, wherein for draining of collected liquid in the compressor with the aid of compressor's compressed gas, the pressure shell is connected to the outlet pipe from the compressor via a compressor draining valve which is arranged between the gas outlet pipe and the compressor, draining taking place with the aid of compressed gas supplied via the compressor draining valve.

17. The device according to claim 16, wherein the draining takes place via a lower valve when the pressure shell is oriented in a vertical direction, alternatively via at least one valve arranged in a side wall when the pressure shell is oriented horizontally, and that drained liquid is passed via the at least one valve arranged in the side wall back to the liquid collector.

18. The device according to any one of claims 15 to 17, wherein the outlet pipe for gas is equipped with an outlet shut-off valve, and the compressor draining valve is placed in connection with the gas outlet pipe after the outlet shut-off valve.

19. The device according to claim 15, wherein a compressor inlet shut-off valve is arranged in a first gas inlet pipe.

20. The device according to claim 15, wherein a compressor inlet shut-off valve is arranged in a second gas inlet pipe.

21. The device according to claim 1, wherein the processing equipment is a compressor with compressor motor.

22. The device according to any one of claims 1 to 5, wherein the draining and flushing function for the liquid collector is combined and the compressed gas is supplied from the gas outlet pipe via the intermediate valve or a flushing valve.

23. The device according to claim 10, wherein the choke valve is fixed.

24. The device according to claim 23, wherein the liquid outlet pipe opens into a mixing point in the fixed choke valve.

25. The device according to claim 23, wherein the fixed choke valve has a converging and a diverging part, and the liquid outlet pipe opens into the mixing point between the converging and the diverging part.

26. The device according to claim 1 or 12, wherein the valve is a non-return valve.

27. The device according to claim 3, wherein the downpipe valve is a non-return valve.

28. The device according to claim 1, wherein a vent pipe with a vent shut-off valve is arranged between the liquid collector and the liquid separator or the inlet pipe to the liquid separator, and the vent shut-off valve is closed during normal operation and during draining of the liquid collector and open for a certain time after draining to obtain pressure equalisation between the liquid separator and the liquid collector.

29. The device according to claim 28, wherein the vent shut-off valve is a non-return valve.

30. The device according to claim 7, wherein the shut-off valve is a non-return valve.

* * * * *